US005453065A

United States Patent [19]

Lien et al.

[11] Patent Number: 5,453,065

[45] Date of Patent: Sep. 26, 1995

[54] EXERCISER WITH COMBINED STEPPING AND TWISTING FUNCTIONS

[75] Inventors: Lan-Tai Lien, San-Chung City; Chih-Jen Lee, Tao-Yuan City, both of Taiwan

[73] Assignee: Kingi Cycle Co., Ltd., San-Chung City, Taiwan

[21] Appl. No.: 290,698

[22] Filed: Aug. 15, 1994

[51] Int. Cl.[6] ..... A63B 22/04; A63B 69/18

[52] U.S. Cl. ..... 482/52; 482/51; 482/146; 482/147; 482/79

[58] Field of Search ..... 482/51, 52, 53, 482/71, 146, 147, 54, 148, 170, 79

[56] References Cited

U.S. PATENT DOCUMENTS

| | | | |
|---|---|---|---|
| 2,573,808 | 11/1951 | Ravoire | 482/146 |
| 3,650,528 | 3/1972 | Natterer | 482/71 |
| 4,391,441 | 7/1983 | Simjian | 482/147 |
| 4,629,181 | 12/1986 | Krive | 482/146 |
| 5,078,389 | 1/1992 | Chen | 482/147 |
| 5,183,448 | 2/1993 | Wang | 482/52 |
| 5,242,340 | 9/1993 | Jerome | 482/147 |
| 5,284,461 | 2/1994 | Wilkinson et al. | 482/147 |
| 5,299,993 | 4/1994 | Habing | 482/52 |
| 5,310,395 | 5/1994 | Ko | 482/79 |
| 5,316,530 | 5/1994 | Romer | 482/71 |

*Primary Examiner*—Jerome W. Donnelly
*Attorney, Agent, or Firm*—Ladas & Parry

[57] ABSTRACT

An exerciser includes a lower stationary support frame having an upright shaft fixed thereto. A stepper mechanism includes a base body mounted rotatably on the shaft and having a front portion and a rear portion, a pair of spaced pedal arms, each of which having a front end pivoted to the front portion and a rear end portion extending from the front end toward the rear portion, and a pair of resistance cylinders, each of which interconnecting the rear end portion of a respective one of pedal arms and the base body. A horizontal plate member is mounted to the shaft above the base body and has two opposite spaced rear portions on two sides of the shaft. A locking unit is provided to lock releasably the plate member on the shaft so as to prevent movement of the plate member relative to the stationary support frame. The exerciser further includes a pair of elongated connecting members, each of which having a front end connected to the front end of a respective one of the pedal arms and a rear end connected to a respective one of the rear portions of the plate member.

5 Claims, 6 Drawing Sheets

EXERCISER WITH COMBINED STEPPING AND TWISTING FUNCTIONS

BACKGROUND OF THE INVENTION

1. Field of the Invention

This invention relates to an exerciser, more particularly to an exerciser with combined stepping and twisting functions.

2. Description of the Related Art

A well known conventional stepper mechanism generally only provides a stepping function. Therefore, an athlete can only exercise his legs with such a stepper mechanism and cannot exercise simultaneously another part of his body.

SUMMARY OF THE INVENTION

Therefore, the objective of this invention is to provide an exerciser with combined stepping and twisting functions.

An exerciser according to this invention includes a lower stationary support frame having an upright shaft fixed thereto. A stepper mechanism includes a base body which is mounted rotatably on the shaft and which has a front portion and a rear portion, a pair of spaced pedal arms, each of which having a front end pivoted to the front portion of the base body and a rear end portion extending from the front end toward the rear portion of the base body, and a pair of resistance cylinders, each of which interconnecting the rear end portion of a respective one of the pedal arms and the base-body.

The exerciser further includes a horizontal plate member which is mounted to the shaft above the base body and which has two opposite spaced rear portions on two sides of the shaft, means for locking releasably the plate member on the shaft so as to prevent movement of the plate member relative to the stationary support frame, and a pair of elongated connecting members, each of which having a front end connected to the front end of a respective one of the pedal arms and a rear end connected to a respective one of the rear portions of the plate member.

Therefore, when pressure is applied on one of the pedal arms to cause downward turning thereof, the respective one of the elongated connecting members pulls the plate member so as to cause rotation of the base body about the shaft relative to the stationary support frame.

The plate member may be sleeved rotatably on a top end portion of the shaft. The locking means may include a locking plate, which is connected fixedly to the shaft above the plate member, and a fastening unit for fastening releasably the plate member to the locking plate so as to lock releasably the plate member on the shaft in order to prevent rotation of the plate member about the shaft. The exerciser may further comprise means for fastening releasably the base body to the stationary support frame in order to prevent rotation of the base body about the shaft relative to the stationary support frame. When the fastening means secures the base body to the stationary support body and the fastening unit releases the plate member from the locking plate, the plate member rotates freely about the shaft while one of the pedal arms is operated to turn downwardly.

The exerciser may further comprise a bushing, which is sleeved around the shaft between the stationary support frame and the plate member and which has an outer wall connected fixedly to the base body of the stepper mechanism, and a bearing unit provided between the bushing and the shaft in order to mount rotatably the bushing on the shaft. A pulley may be secured axially around the outer wall of the bushing below the plate member and may have a rim formed with at least two annular guiding grooves. The plate member has two mounting protrusions, each of which extending downwardly from a respective one of the rear portions of the plate member and each of which having a length corresponding to a vertical distance of the respective one of the annular guiding grooves from the plate member. Each of the elongated connecting members may include a rope which has a front end that is connected to the front end of the respective one of the pedal arms, and a rear end that passes along a portion of the respective one of the annular guiding grooves and that is connected to a respective one of the mounting protrusions of the plate member.

In another embodiment of the exerciser, the exerciser is not provided with the pulley, and each of the elongated connecting members includes a rigid rod which has a front end that is connected to the front end of the respective one of the pedal arms, and a rear end that is connected to the respective one of the rear portions of the plate member.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

Figure 1:
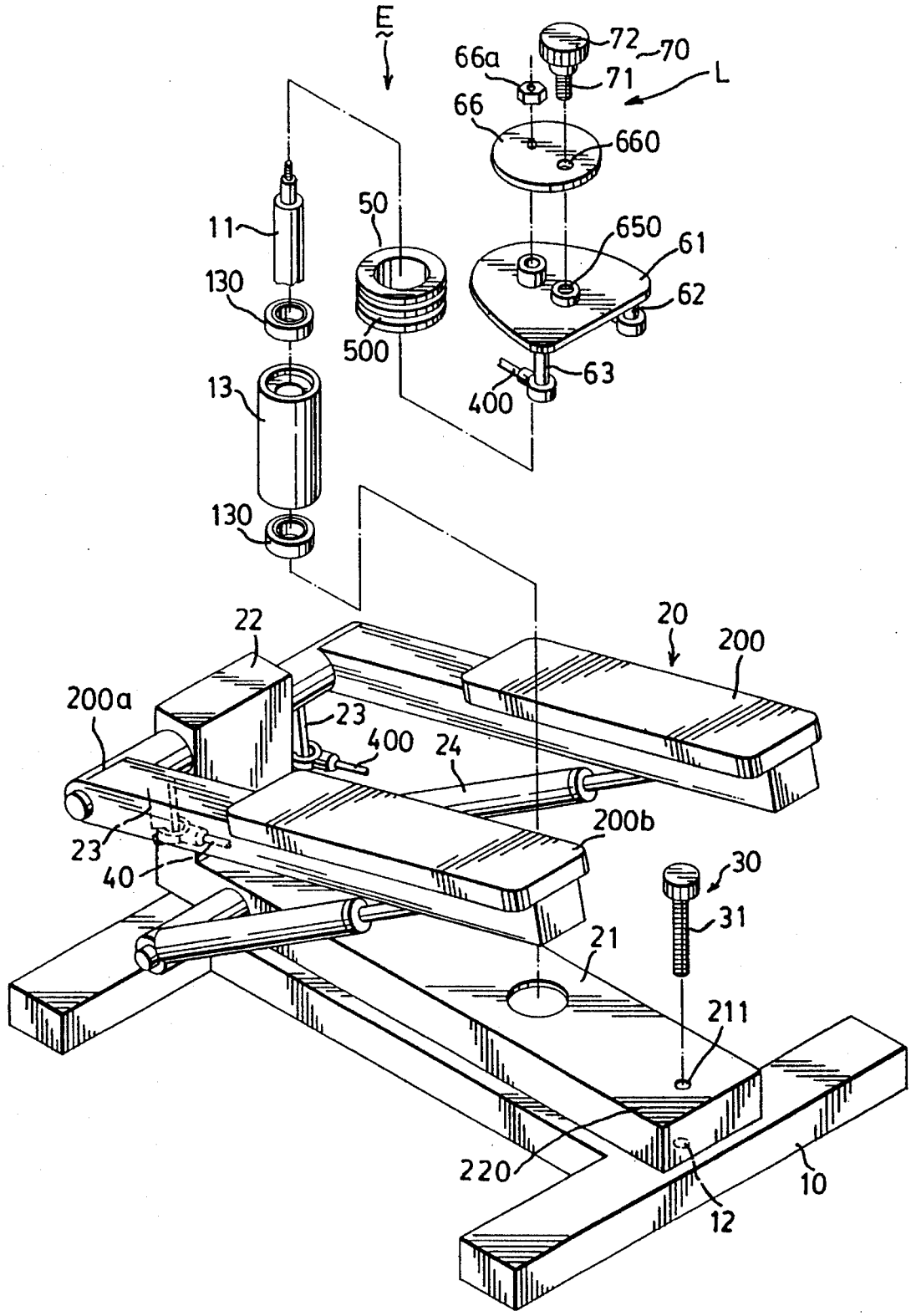
FIG. 1 is a partially exploded view of an exerciser according to this invention.
Figure 2:
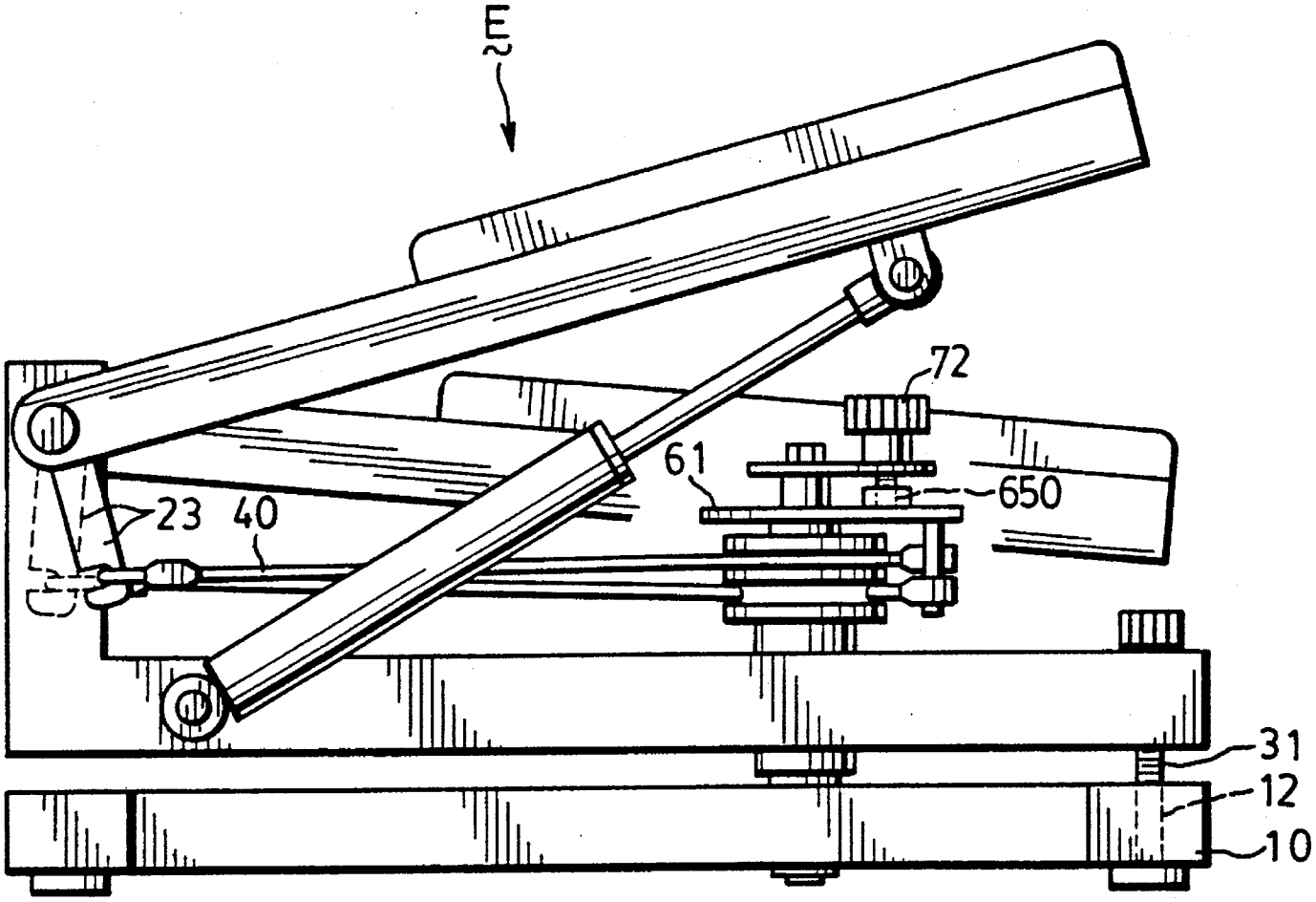
FIG. 2 is a side view of the exerciser of this invention.
Figure 3:
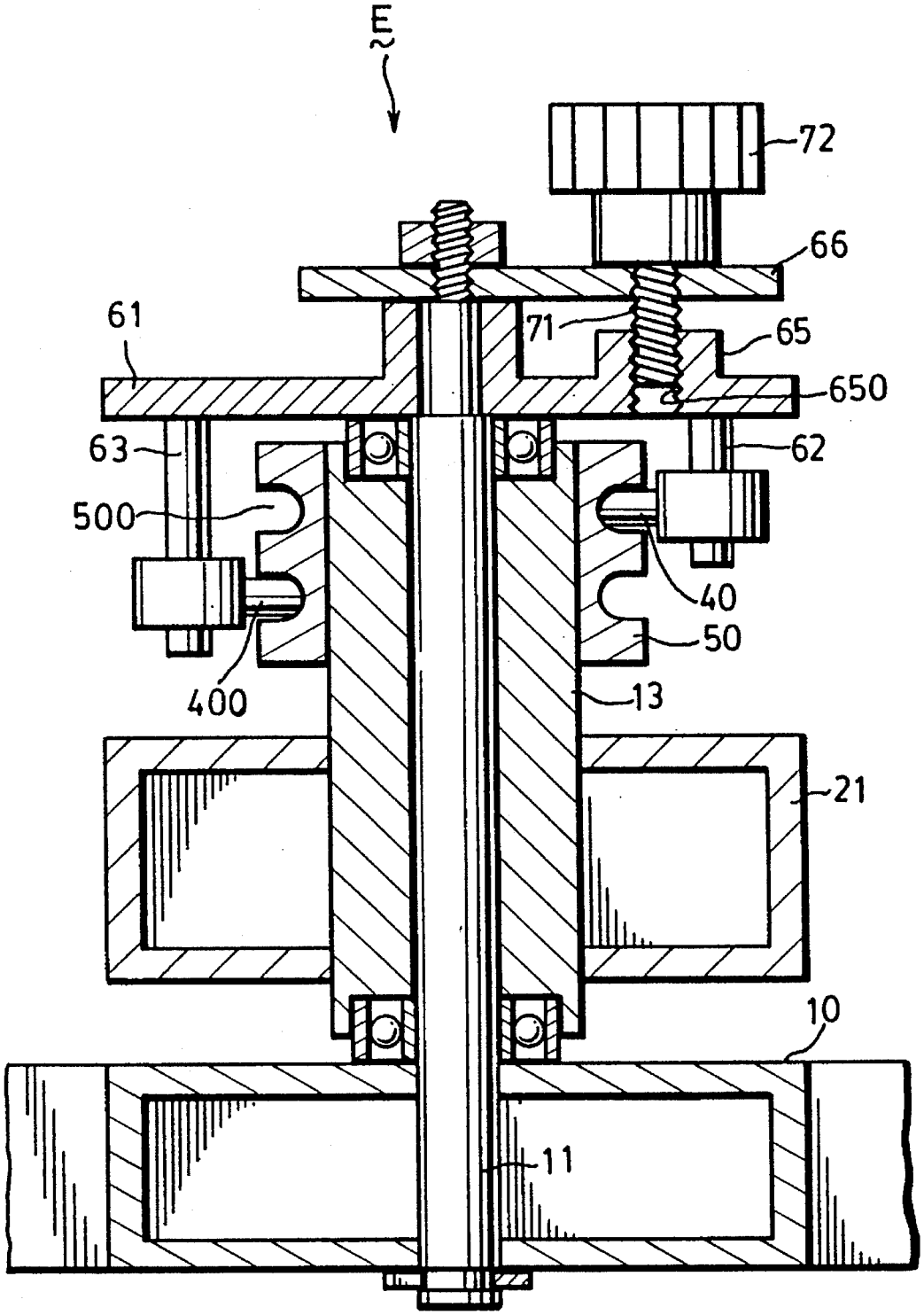
FIG. 3 is a sectional view of the exerciser of this invention when a plate member is secured non-rotatably to a locking plate.

Referring to FIGS. 1, 2 and 3, an exerciser (E) according to this invention includes a lower stationary support frame 10, which has an upright shaft 11 fixed thereto, and a stepper mechanism 20. The stepper mechanism 20 includes a base body 21 which is mounted rotatably on the shaft 11 above the stationary support frame 10 and which has an upright front portion 22 and a rear portion 220, a pair of spaced pedal arms 200, each of which has a front end (200*a*) pivoted to the front portion 22 of the base body 21 and a rear end portion (200*b*) extending from the front end (200*a*) toward the rear portion 220 of the base body 21, and a pair of resistance cylinders 24, each of which interconnects the rear end portion (200*b*) of a respective one of the pedal arms 200 and the base body 21. The resistance cylinder 24 may be a hydraulic cylinder associated with a piston rod. The stepper mechanism 20 has a pair of hook mounting members 23, each of which extends downwardly from the front end (200*a*) of a respective one of the pedal arms 200.

The exerciser (E) has a horizontal plate member 61 mounted to the shaft 11 above the base body 21, and means (L) for locking releasably the plate member 61 on the shaft 11 in order to prevent movement of the plate member 61 relative to the stationary support frame 10. The plate member 61 is sleeved rotatably on a top end portion of the shaft 11 and has two opposite spaced rear portions on two sides of the shaft 11. The locking means (L) includes a locking plate 66, which is connected fixedly to the shaft 11 above the plate member 61 by means of a nut (66*a*), and a fastening unit 70 for fastening releasably the plate member 61 to the locking plate 66 so as to lock releasably the plate member 61 to the shaft 11 in order to prevent rotation of the plate member 61 about the shaft 11 with respect to the stationary support frame 10. The fastening unit 70 has a bolt 71 which is associated with a rotary head 72 and which can pass threadably through a hole 660 in the locking plate 66 and a hole 650 in the plate member 61 in order to secure releasably the plate member 61 to the locking plate 66.

A bushing 13 is sleeved around the shaft 11 between the stationary support frame 10 and the plate member 61 and has an outer wall connected fixedly to the base body 21 of the stepper mechanism 20. A bearing unit includes a pair of bearings 130 provided between the bushing 13 and the shaft 11 in order to mount rotatably the bushing 13 on the shaft 11.

The exerciser (E) includes a pulley 50 which is secured axially around the outer wall of the bushing 13 below the plate member 61 and which has a rim formed with two annular guiding grooves 500. The plate member 61 has two mounting protrusions 62, 63, each of which extends downwardly from a respective one of the rear portions of the plate member 61 and each of which has a length corresponding to a vertical distance of the respective one of the annular guiding grooves 500 from the plate member 61. Referring to FIG. 3, the vertical length of the mounting protrusion 62 corresponds to the vertical distance of an upper one of the annular guiding grooves 500, while the vertical length of the mounting protrusion 63 corresponds to the vertical distance of a lower one of the annular guiding grooves 500.

The exerciser (E) includes two elongated connecting members. In the present preferred embodiment, the elongated connecting members includes two ropes 40, 400. Each rope 40, 400 has a front end which is connected to a respective one of the hook mounting members 23 on the pedal arms 200 and a rear end which passes along a portion of a respective one of the annular guiding grooves 500 and which is connected to the respective one of the mounting protrusions 62, 63 of the plate member 61. It is noted that the left rope 40 passes along a portion of the upper one of the annular guiding grooves 500 and is connected to the mounting protrusion 62, while the right rope 400 passes along a portion of the lower one of the annular guiding grooves 500 and is connected to the mounting protrusion 63.

The exerciser (E) includes means 30 for fastening releasably the base body 21 to the stationary support frame 10 in order to prevent rotation of the base body 21 about the shaft 11 relative to the stationary support frame 10. The fastening means 30 has a bolt 31 which can pass threadably through a hole 211 in the rear portion 220 of the base body 21 and a hole 12 in the stationary support frame 10 so as to lock the base body 21 to the stationary support frame 10.

Figure 4:
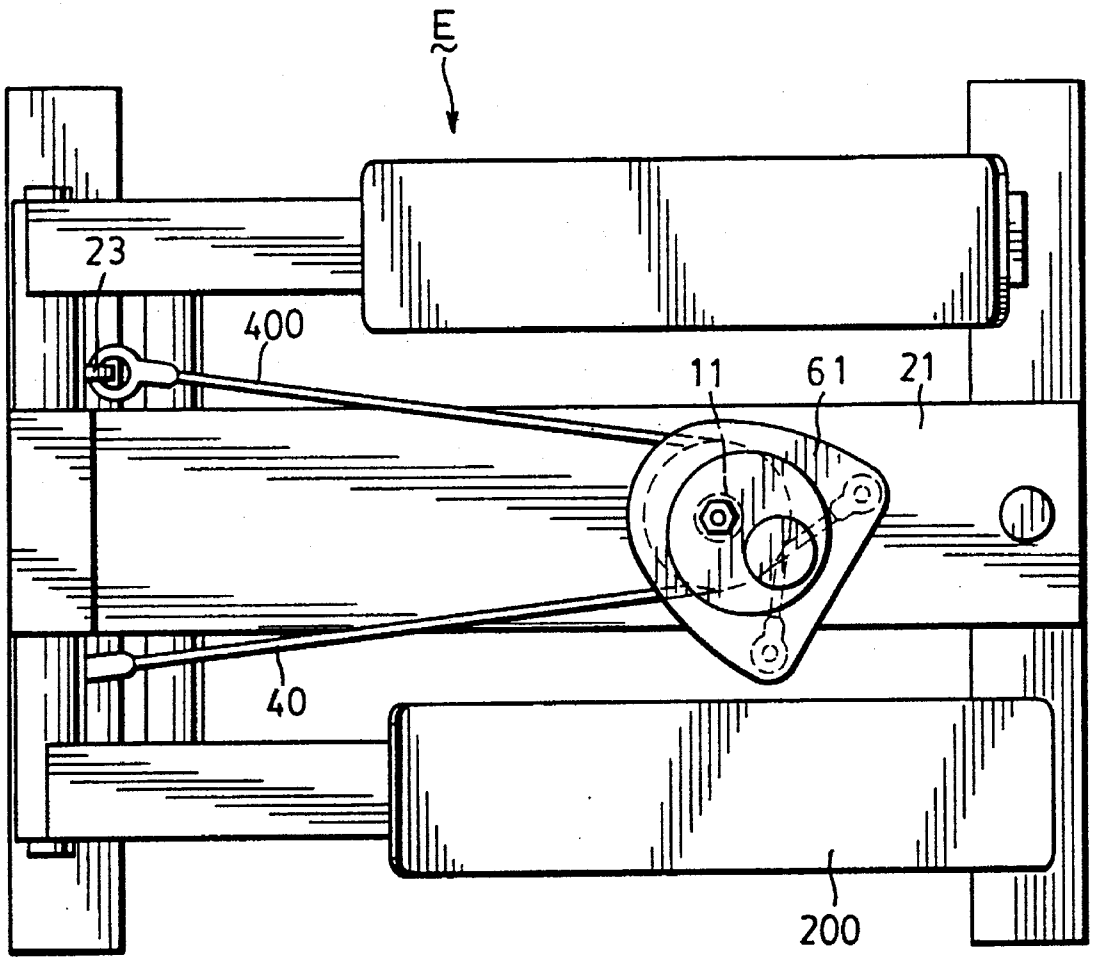
FIG. 4 is a top view of the exerciser of this invention when the plate member rotates freely about a shaft while one of pedal arms is operated.

FIG. 4 shows the operation of the exerciser (E) when the bolt 31 of the fastening means 30 secures the base body 21 to the stationary support frame 10 and the bolt 71 of the locking means (L) releases the plate member 61 from the locking plate 66. Under such a condition, the base body 21 is non-rotatable and the plate member 61 is rotatable about the shaft 11. When the left one of the pedal arms 200 is operated to turn downwards, the left one of the hook mounting members 23 and the rope 40 move forwards such that the rope 40 pulls the plate member 61 so as to cause rotation of the plate member 61 about the shaft 11. According to such an operation, an athlete can step the pedal arms 200 to exercise his legs.

Figure 5:
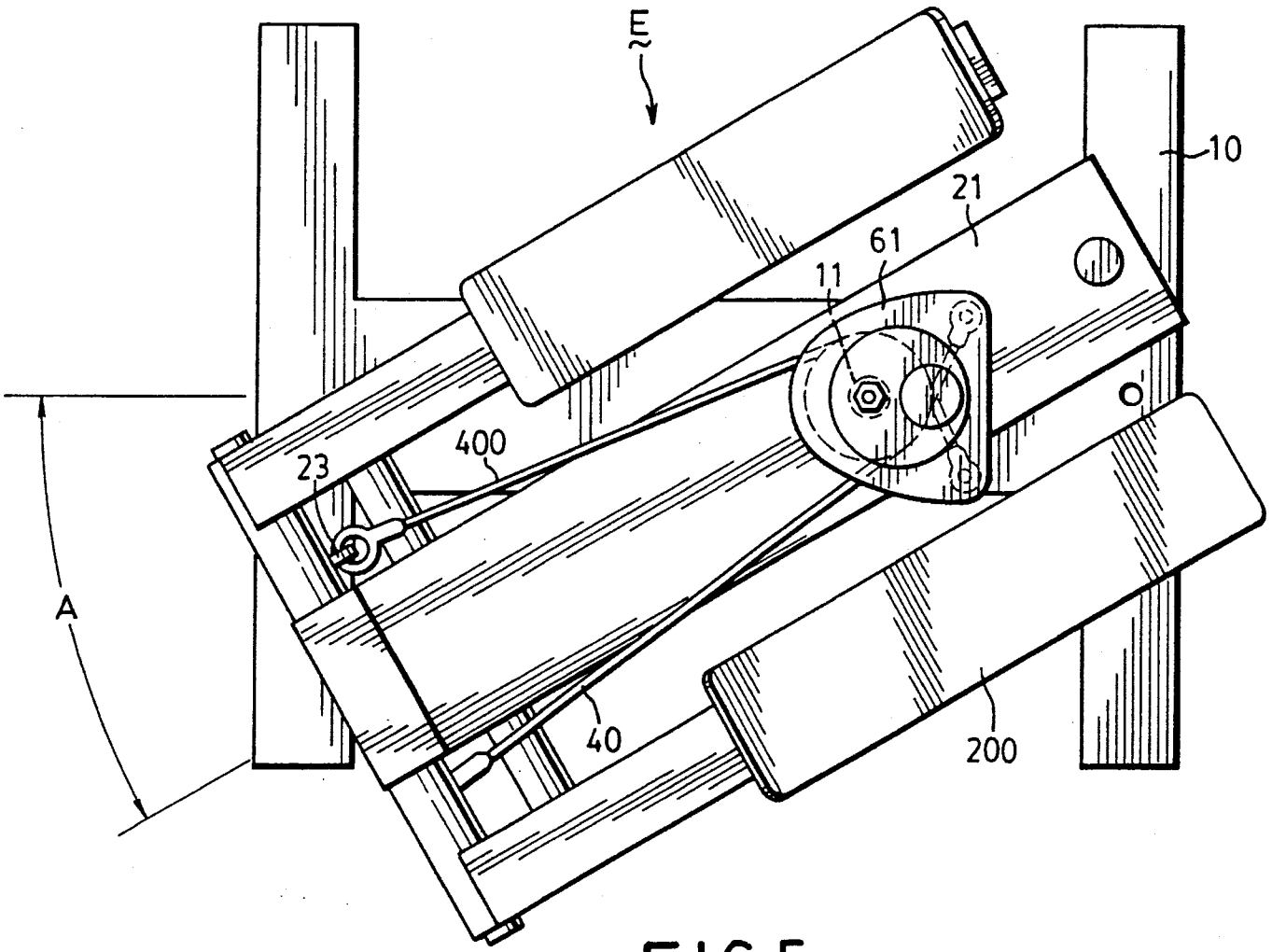
FIG. 5 is a top view of the exerciser of this invention when a base body of a stepper mechanism rotates about the shaft while one of pedal arms is operated.

Referring to FIG. 5, the bolt 31 of the fastening means 30 releases the base body 21 from the stationary support frame 10 and the bolt 71 of the fastening unit 70 secures the plate member 61 to the locking plate 66 such that the base body 21 is rotatable and the plate member 61 is non-rotatable about the shaft 11. When the left one of the pedal arms 200 is operated to turn downwards, the left one of the hook mounting members 23 and the rope 40 move forwards such that the rope 40 pulls the plate member 61 so as to cause rotation of the base body 21 about the shaft 11. It is noted that the base body 21 rotates by an angle (A) in an anticlockwise direction. When the right one of the pedal arms 200 is operated to turn downwards, the rope 400 is actuated to pull the plate member 61 so as to cause rotation of the base body 21 about the shaft 11 in a clockwise direction. Since the stepper mechanism 20 of the exerciser (E) is rotatable during the operation of the pedal arms 200, the exerciser (E) can provide simultaneously stepping and twisting functions. Thus, the athlete can exercise simultaneously his legs and waist by the use of the exerciser (E).

Figure 6:
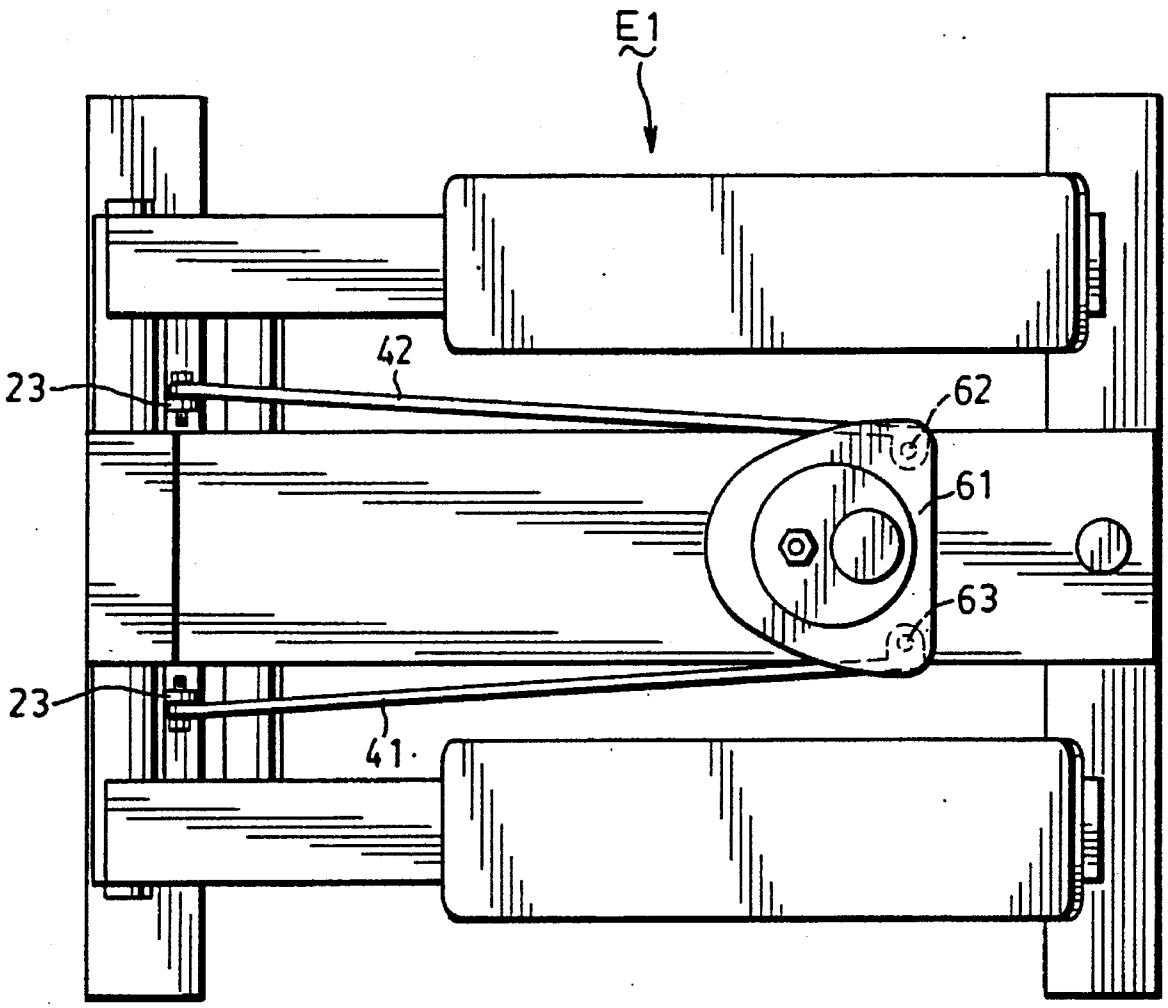
FIG. 6 is a top view of another preferred embodiment of the exerciser of this invention.

FIG. 6 shows another preferred embodiment (El) of the present invention. The exerciser (El) of the present invention is not provided with the pulley 50 as in the previous embodiment. The elongated connecting members of the exerciser (El) include two rigid rods 41, 42. The rod 41 has a front end connected to the left one of the hook mounting members 23 and a rear end connected to the mounting protrusion 63 of the plate member 61. The rod 42 has a front end connected to the right one of the hook mounting members 23 and a rear end connected to the mounting protrusion 62. The operation of the second preferred embodiment is similar to that of the previous embodiment and will not be detailed further.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. An exerciser with combined stepping and twisting functions, comprising:

a lower stationary support frame having an upright shaft fixed thereto;

a stepper mechanism including:

a base body mounted rotatably on said shaft and having a front portion and a rear portion, a pair of spaced pedal arms, each pedal arm having a pedal arm front end pivotably attached to said front portion of said base body, each pedal arm front end having a mounting member attached thereto, and each pedal arms having a pedal arm rear end portion extending from said front end toward said rear portion of said base body, and a pair of resistance cylinders, each of which is pivotably connected between said pedal arm rear end portion of a respective one of said pedal arms and said base body;

a plate member rotatably mounted to said shaft above said base body and having two opposite spaced mounting protrusions on two sides of said shaft, and having means for locking releasably said plate member on said shaft so as to prevent movement of said plate member relative to said stationary support frame; and a pair of elongated connecting members, each elongated connecting member having a connecting member front end connected to a respective one of said mounting members of said pedal arms and a connecting member rear end connected to a respective one of said mounting protrusions of said plate member, wherein, when said means for locking releasably said plate member, is locking said plate member to said shaft, one of said elongated connecting members pulls said plate member so as to cause rotation of said base body about said shaft relative to said stationary support frame when pressure is applied to a respective one of said pedal arms to cause downward turning thereto.

2. An exerciser as claimed in claim 1, wherein said plate member is sleeved rotatably on a top end portion of said shaft, said locking means having a locking plate connected fixedly to said shaft above said plate member and a fastening unit for fastening releasably said plate member to said locking plate so as to lock releasably said plate member on said shaft in order to prevent rotation of said plate member about said shaft, said exerciser further comprising means for fastening releasably said base body to said stationary support frame in order to prevent rotation of said base body about said shaft relative to said stationary support frame, whereby, when said fastening means secures said base body to said stationary support body and said fastening unit releases said plate member from said locking plate, said plate member rotates freely about said shaft while one of said pedal arms is operated to turn downwards.

3. An exerciser as claimed in claim 2, further comprising a bushing, which is sleeved around said shaft between said stationary support frame and said plate member and which has an outer wall connected fixedly to said base body of said stepper mechanism, and a bearing unit provided between said bushing and said shaft in order to mount rotatably said bushing on said shaft.

4. An exerciser as claimed in claim 3, further comprising a pulley which is secured axially around said outer wall of said bushing below said plate member and which has a rim formed with at least two annular guiding grooves, each of said mounting protrusions extending downwardly from said plate member and having a length corresponding to a vertical distance of the respective one of said annular guiding grooves from said plate member, each of said elongated connecting members including a rope having said connecting member front end which is connected to the respective one of said mounting members of said pedal arms, and said connecting member rear end which passes along a portion of the respective one of said annular guiding grooves and which is connected to the respective one of said mounting protrusions of said plate member.

5. An exerciser as claimed in claim 1, wherein each of said elongated connecting members includes a rigid rod having said connecting member front end connected to the respective one of said mounting members of said pedal arms and said connecting member rear end connected to the respective one of said mounting protrusions of said plate member.

* * * * *